US006328093B1

(12) United States Patent
Zajber et al.

(10) Patent No.: US 6,328,093 B1
(45) Date of Patent: Dec. 11, 2001

(54) STRAND GUIDING SEGMENT FOR SLAB CASTING PLANTS

(75) Inventors: Adolf Zajber, Langenfeld; Martin Becker, Düsseldorf; Gerhard Arnolds, Mülheim, all of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/320,437

(22) Filed: May 26, 1999

(30) Foreign Application Priority Data

May 30, 1998 (DE) ..... 198 24 366

(51) Int. Cl.[7] ..... B22D 11/12
(52) U.S. Cl. ..... 164/442; 164/448
(58) Field of Search ..... 164/442, 448, 164/484

(56) References Cited

U.S. PATENT DOCUMENTS 4,131,154 * 12/1978 Vial et al. ..... 164/448
4,485,837 * 12/1984 Wiesinger et al. ..... 164/448
4,590,986 * 5/1986 Scholz et al. ..... 164/448
5,152,334 * 10/1992 Gallucci ..... 164/484
5,348,074 * 9/1994 Streubel ..... 164/476
5,915,460 * 6/1999 Courson et al. ..... 164/484

FOREIGN PATENT DOCUMENTS 196 27 336 C1 9/1997 (DE) .

* cited by examiner

*Primary Examiner*—Tom Dunn
*Assistant Examiner*—Len Tran
(74) *Attorney, Agent, or Firm*—Friedrich Kueffner

(57) ABSTRACT

A strand guiding segment for slab casting plants with a guiding width for the cast strand is adjustable between guide rollers of a frame on a fixed side and a frame on a detachable side, wherein the frames interact with adjusting units for overcoming the ferrostatic pressure and for adjusting the desired sectional width of the strand. The adjusting units are four independently adjustable pressure cylinders arranged outside of the radiation range at the upper side of the segment, wherein the distance between the segment middle and cylinder which determines the segment width is reduced on both sides by the dimension of the cylinder which has been moved to the upper side of the segment. The segment crossbeams are provided with radiation protection plates instead of water cooling means and cooled side frames are laterally flanged to the bottom frames.

4 Claims, 5 Drawing Sheets

STRAND GUIDING SEGMENT FOR SLAB CASTING PLANTS

BACKGROUND OF THE INVENTION

1. Field of the Invention

The present invention relates to a strand guiding segment for slab casting plants with a guiding width for the cast strand which is adjustable between guide rollers of a frame on a fixed side and a frame on a detachable or loose side, wherein the frames interact with adjusting means for overcoming the ferrostatic pressure and for adjusting the desired sectional width of the strand.

2. Description of the Related Art

The configuration of the strand guiding segments and the base frames is an essential factor for the competitiveness in the field of continuous casting plants. The strand guiding segments and the base frames must meet the operational requirements in an optimum manner, on the one hand, and, on the other hand, they must be competitive with respect to cost, particularly because, depending on the requirements, the portion of the costs of the strand guidance constitutes about 30 to 70% of the total costs of the plant.

Continuous casting plants, particularly continuous casting plants for casting steel slabs, utilize rollers for guiding the strand, wherein the rollers serve to limit the thickness of the strand which is not yet fully solidified and to prevent bulging of the strand shell due to the ferrostatic internal pressure.

For this purpose, groups of at least four pairs of rollers are usually combined into segments. The strand guiding rollers arranged above the strand are mounted on the upper part of the segment or on the detachable frame part, while the strand guiding rollers located below the strand are mounted on the lower part of the segment or the fixed part of the segment. The fixed part and the detachable part of the individual segments are usually connected to each other through four tension cylinders. These so-called clamping cylinders pull the upper part of the segment onto spacers, so that the desired opening width between the oppositely located rollers is obtained. This opening width corresponds to the strand thickness.

Modern process technologies for improving the product quality make it necessary that the opening width can be changed during the casting process. Particularly the so-called soft reduction in the area of the tip of the liquid phase of the strand requires a conical adjustment and a variable opening width adjustment of the corresponding segment. A conventional possibility for changing the opening width of segments with four clamping cylinders is to construct the cylinders with hydraulic servo position control.

DE 196 27 336 C1 discloses a method and an apparatus for guiding a strand in a continuous casting plant with a soft reduction section in which the hydraulic servo units adjust the opening width of the oppositely located strand guiding rollers in an infinitely variable manner. The conventional strand guiding unit, which has in each segment four servo distance/cylinder units for the infinitely variable adjustment of the opening width of the oppositely located strand guiding rollers, is characterized in that the hydraulic lines connect the annular surfaces and piston surfaces of two adjacent servo piston/cylinder units to a common servo valve, and that position pickups of the servo piston/cylinder units controlled by a common servo valve can be coupled to each other through control technology.

The clamping cylinders are usually arranged on the segment laterally next to the rollers and, thus, are located together with the hydraulic lines and servo valves of the servo piston/cylinder units in the range of the radiation influence of the cast strand. Consequently, the clamping cylinders must be arranged at such a distance between the middle of the segment and the hydraulic cylinders that the radiation influence remains within acceptable limits. Because of the load influence on the frames, the required width of the frames of the segment leads to a comparatively great structural weight which, in turn, significantly increases the cost of the manufacture and assembly and the costs of the strands.

SUMMARY OF THE INVENTION

Therefore, starting from the prior art discussed above, it is the primary object of the present invention to significantly simplify a strand guiding element for slab casting machines of the above-described type as compared to conventional constructions, so that a significant saving of costs of the manufacture and assembly of the strand guiding elements is achieved while using pressure cylinders which are located outside of the cooling chamber due to the fact that they are supported in the area of the upper frame and by providing a lighter weight frame construction and a simplified water cooling system as well as locations of the lines for the roller cooling means.

It must be taken into consideration in this connection that the room for structural improvements in a component which has been technically further developed with continuous progress over decades is relatively small, so that at first glance it would appear that significant improvements and cost savings are not possible.

In this connection, the present invention which provides an innovative segment adjustment with upper pressure cylinders is further based on the concept of finding solutions for dynamically adjustable controllable upper frames of the segment, so that

- the upper frame is pivotable with respect to all axes while being stiff with respect to bending and twisting, wherein
- an adjustment of the upper frame is possible with exact dimensional accuracy of the desired opening width geometry with respect to thickness and inclination in the direction of the longitudinal and width axis,
- the hydraulic cylinders can be constructed as pressure cylinders with relatively small diameters in order to reduce the load moment by reducing the lever arm, wherein
- the cylinders including their measuring and control units are located outside of the cooling chamber, and wherein
- the outer segment rollers are drivable due to the changed construction,
- so that, while simultaneously operating in an optimum manner, an inexpensive segment type is obtained which is superior to the conventional type with tension cylinders and replaces the conventional type.

In accordance with the present invention, the above object is surprisingly met by

- providing as adjusting means four independently adjustable pressure cylinders and arranging the pressure cylinders outside of the radiation range at the upper side of the segment, wherein the distance between the segment middle and cylinder which determines the segment width is reduced on both sides by the dimension of the cylinder which has been moved to the upper side of the segment, providing the segment crossbeams with radiation protection plates instead of water cooling means, and by flanging cooled side frames laterally to the bottom frames.

As a result of the configuration according to the present invention, the cylinders are connected in a novel manner and are located outside of the radiation range of the strand on the upper side of the segment and, thus, the cylinders including their pipe connections and valve arrangements are less susceptible to thermal danger. Moreover, because of the smaller segment width, the frame construction may have a significantly smaller weight while the stiffness remains the same; this is because the lever arm between the pressure cylinders and the ferrostatic force is reduced. In addition, tests have shown that by providing the segment crossbeams with radiation protection plates, the previously used complicated crossbeam and frame cooling means using cooling water is no longer required for preventing an undue heating of the crossbeams; also contributing to this is the fact that cooled side frames are flanged laterally to the bottom frame.

Additional advantageous results are obtained by providing significant further developments of the strand guiding segment according to present invention for an optimum solution of the above-mentioned object. These results are a box-shaped side frame part is constructed as a water-conducting duct; and water connections for cooling the rollers are arranged on one side of the strand guiding element. This results in significant simplifications of the line arrangement and their connections for the roller cooling. Additional advantageous features are the upper frame is constructed so as to be stiff with respect to bending and twisting and the upper frame is cardanically connected to the hydraulic cylinders so as to be pivotable with respect to all three axes;

the hydraulic cylinders as pressure cylinders have relatively small diameters, so that the load moment is reduced due to the fact that the lever arm is shorter;

the configuration and the rigid arrangement of the side frame produces the possibility of moving the frames on spacer pieces and, thus, to adjust the roller distance, for example, in accordance with the segment thickness;

the hydraulic cylinders are located outside of the cooling chamber, so that the cylinders including the measuring and control units are subjected to permissible temperatures;

this is also true for the hydraulic pipes and the coupling elements thereof which are located completely outside of the cooling chamber;

with the cylinders being mounted in the side frames and the upper frame being dynamically adjustable relative to the hot strand pressure $P_{ferroi}$ the upper frame is freely adjustable and pivotable with respect to its three axes, wherein this is effected with an exact dimensionally correct positioning by using its cardanic mounting, without producing horizontal constraining forces in the bearings during the adjusting processes.

Finally, in accordance with an advantageous feature, the cylinders are connected to the frame on the detachable side either by arranging the pressure cylinders with their flanges in a support having the shape of a spherical recess or by connecting the cylinders rigidly to the side frame and connecting the cylinders to the frame on the detachable side by a double universal joint with free movement to all sides.

The structural simplifications and improvements of the strand guiding segment according to the present invention make it possible to more easily realize a standardization of the structural components of the segment because of the uncomplicated construction thereof. Accountings have shown that the invention makes it possible to significantly reduce the manufacturing costs of the strand guiding segments. Further contributing to this is the fact that the new connection of the cylinders using pressure cylinders instead of clamping cylinders makes it possible to use commercially available standard cylinder types which can be obtained at relatively low prices. In addition, the costs can be further reduced by standardizing the rollers, for example, by reducing the various different roller diameters and bearing types.

The features according to the present invention provide the following significant advantages:

use of four pressure cylinders above the segment, i.e. outside of the range of radiation of the strand;

small segment width by reducing the distance between segment middle and cylinder;

use of radiation protection plates for the crossbeams;

cooled side frames flanged laterally to the bottom frames;

minimization of the pipe lines by using box-shaped side parts for conducting water, providing water connections only on one side of the segment, and replacing the crossbeam cooling by radiation protection plates.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
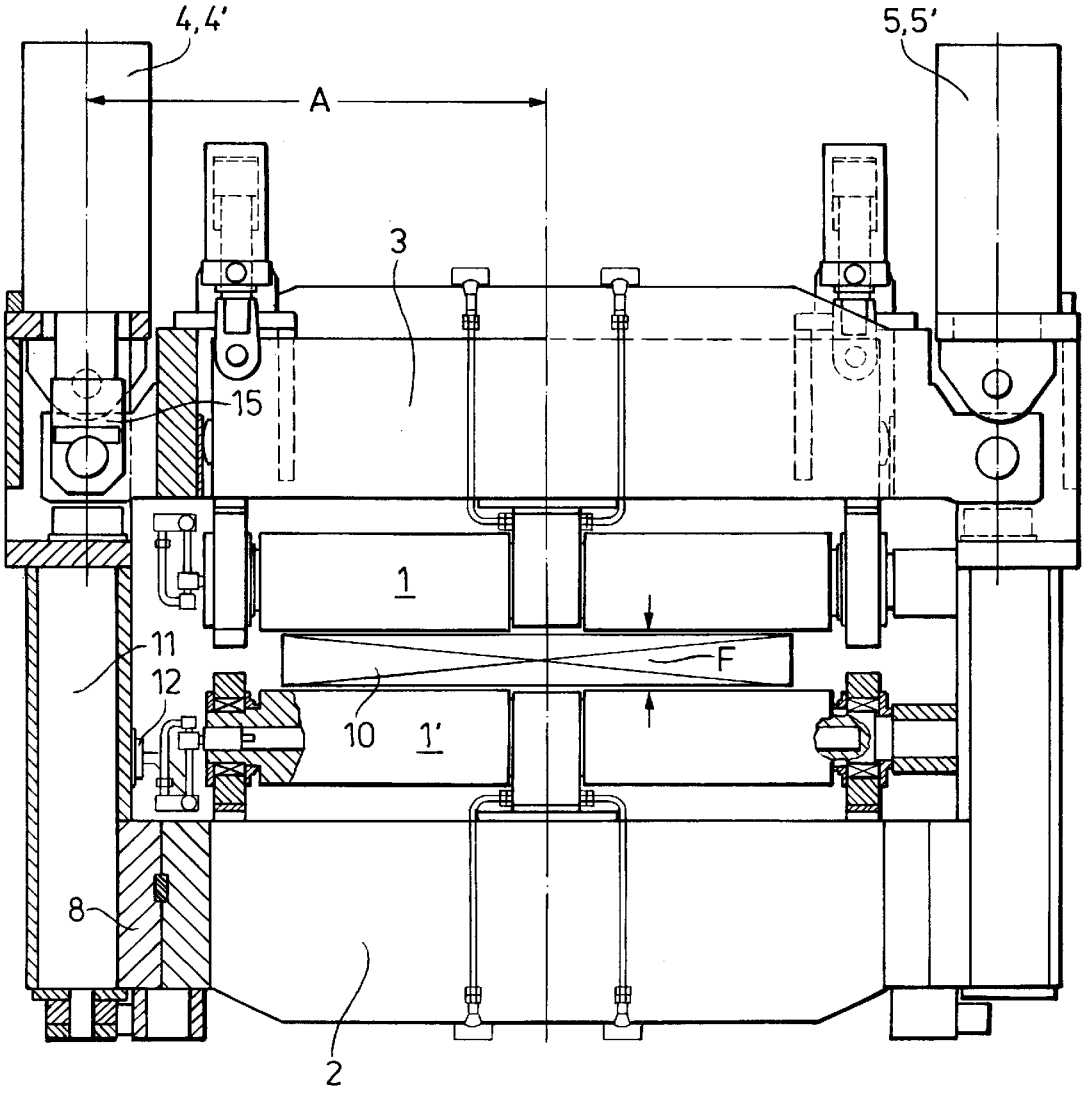
FIG. 1 is front view, partially in section, of a strand guiding segment.

The strand guiding segment for slab casting plants illustrated in FIG. 1 provides between guide rollers 1 of a frame 3 on the detachable side and guide rollers 1' of a frame on the fixed side a guide width F for the cast strand 10 which is adjustable, wherein the frames 2, 3 interact with adjusting means for overcoming the ferrostatic pressure and for adjusting the desired sectional width of the strand 10.

In accordance with the present invention, provided as adjusting means are four independently adjustable pressure cylinders 4, 4'; 5, 5' which are arranged outside of the radiation range of the strand on the upper side of the segment, wherein the distance A between the middle of the segment and the cylinder which determines the width of the segment is reduced on both sides by the dimensions of the cylinders 4, 5 which have been moved to the upper side of the segment.

Figure 2:
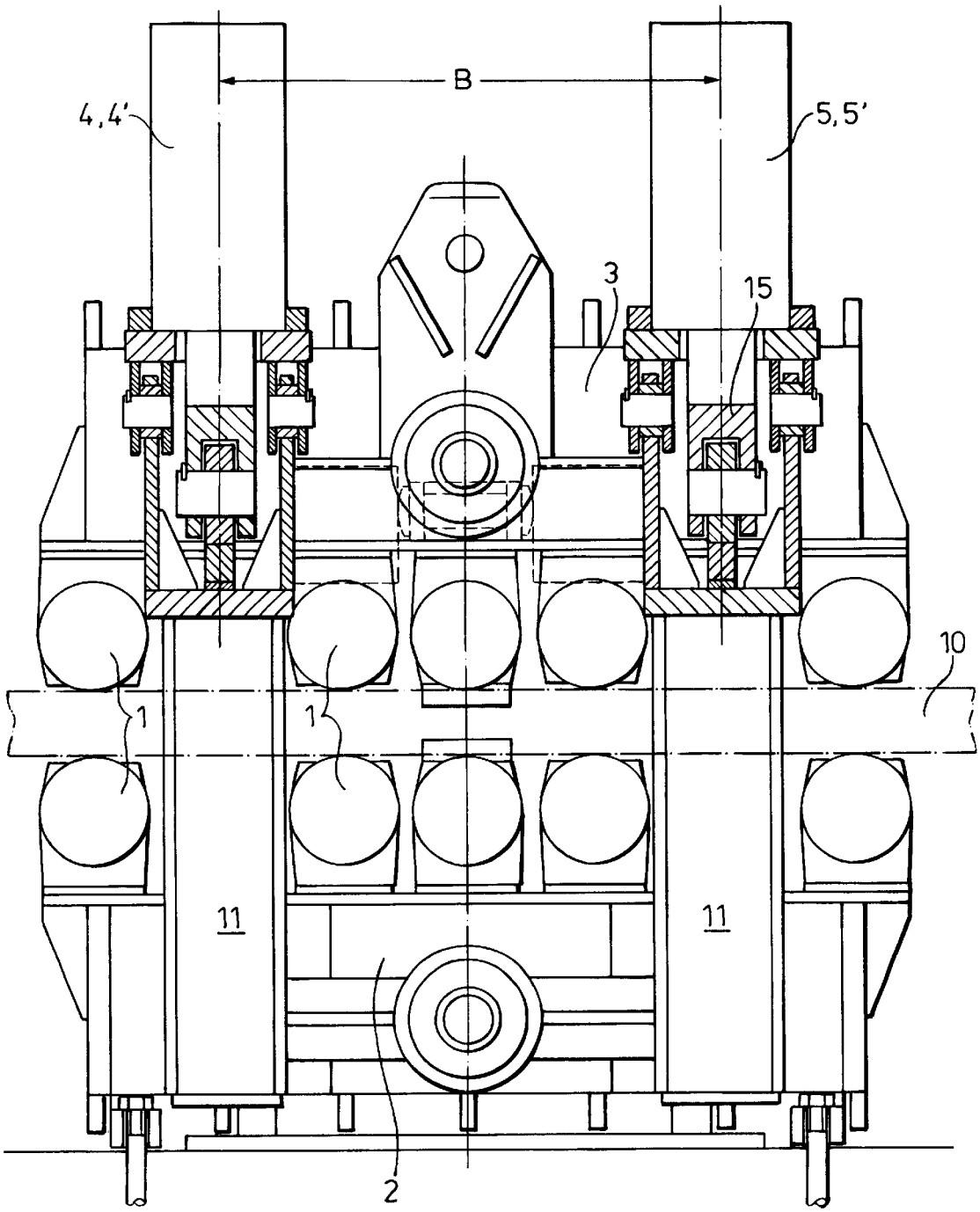
FIG. 2 is a side view, also partially in section, of the strand guiding segment of FIG. 1.

As can be seen in FIG. 2, the shift of the pressure cylinders 4, 4'; 5, 5' to the upper side of the segment outside of the radiation range provides the possibility of making the lateral distance B from each pair of cylinders 4, 5 substantially smaller than in conventional constructions and, thus, of contributing to a lighter structural weight of the segment because of reduced bending moments of the frame.

FIGS. 1 and 2 of the drawing further show the connection of each pressure cylinder 4 or 5 to side frames 11 by means of a universal joint 15. In this connection, FIG. 1 shows in the lower left corner thereof the connection of the guide frame 2 through the bottom frame 8 to the side frame 11 to form a compact structural unit. Moreover, the sectional view shows the water connection 12 to the water-conducting side frame 11. This significantly simplifies the arrangement of the pipes for the cooling system of the rollers 1, 1'. The cast strand 10 guided between the guide rollers 1 is shown in FIG. 2 in dash-dot lines.

Figure 3:
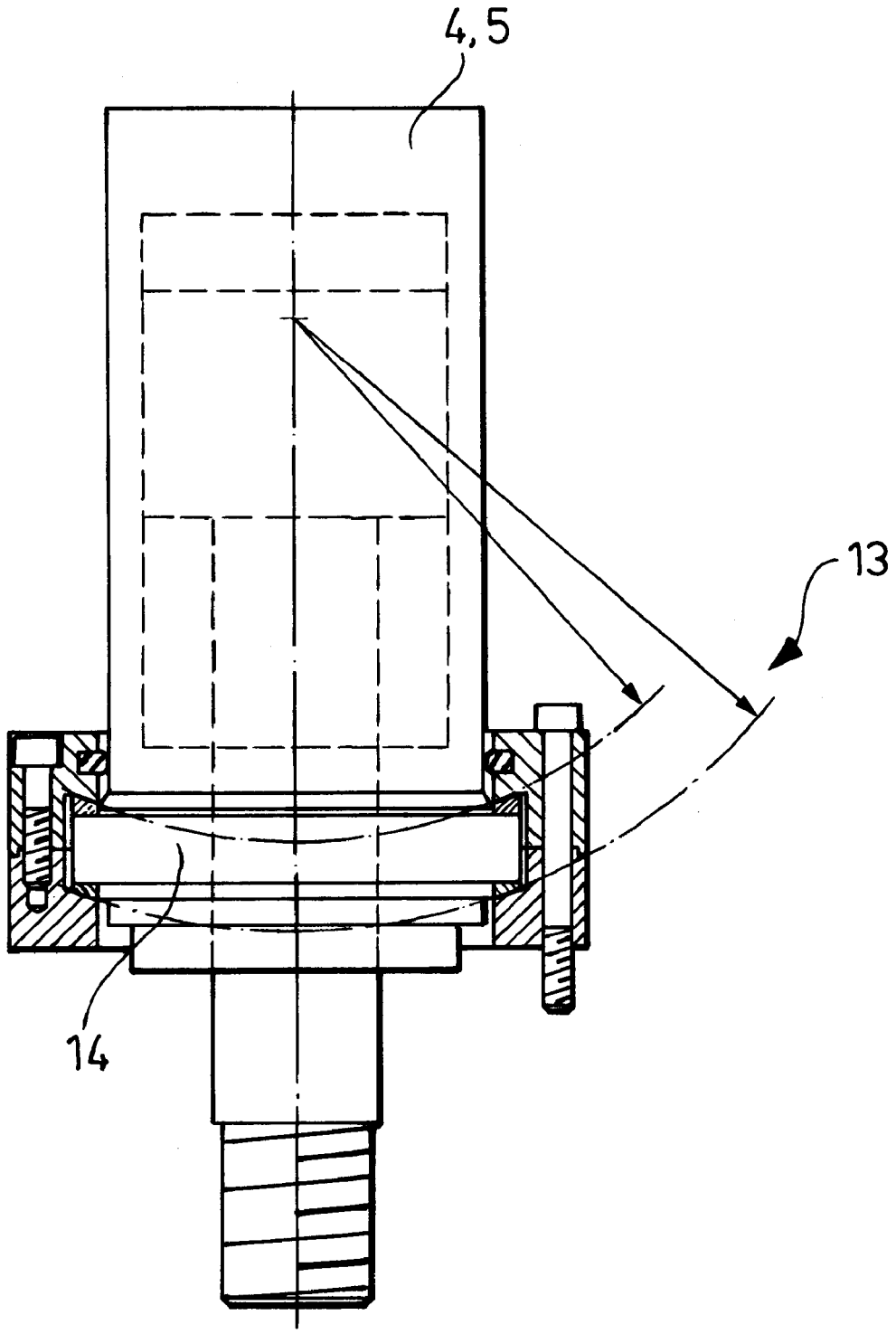
FIG. 3 is a side view, partially in section, of a hydraulic pressure cylinder whose flange is mounted on a spherical surface.
Figure 3A:
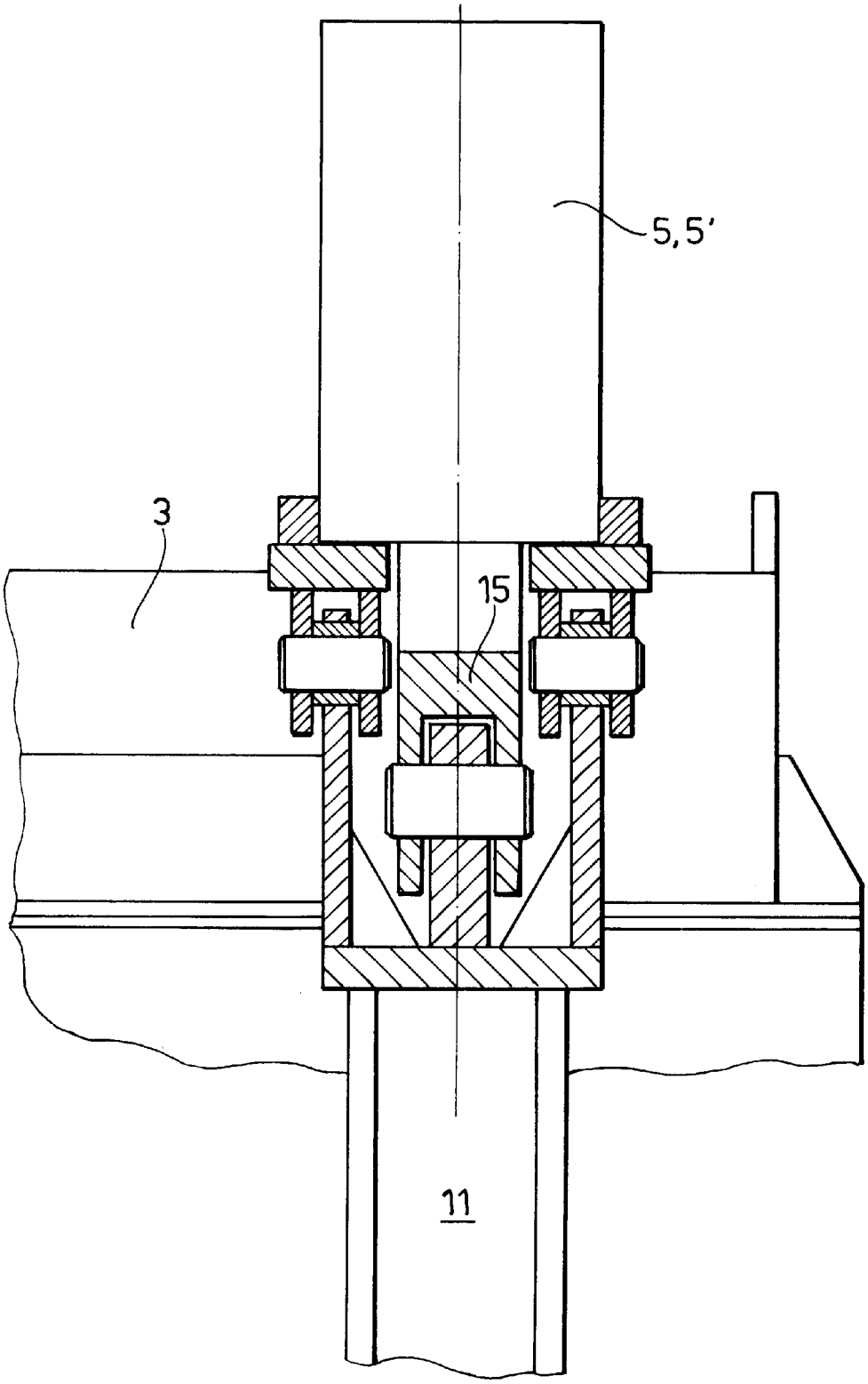
FIG. 3*a* is a side view, partially in section, of a hydraulic pressure cylinder with immovable mounting and connection to the frame on the detachable side through a double universal joint arrangement with free movement to all sides.

FIG. 3 of the drawing shows a standard pressure cylinder 4, 5 whose flange 14 is received in a spherically curved guide means 13. However, a rigid attachment as shown in FIG. 3 is also possible, wherein a double universal joint is connected to the frame 3 on the detachable side. This feature and the cardanic connection of the universal joint 15, shown in FIGS. 1 and 2 as well as especially in FIG. 3a, result in an optimum force transmission between a cylinder 4, 4'; 5, 5' and one of the side frames 11 without lateral constraints.

Figure 4:
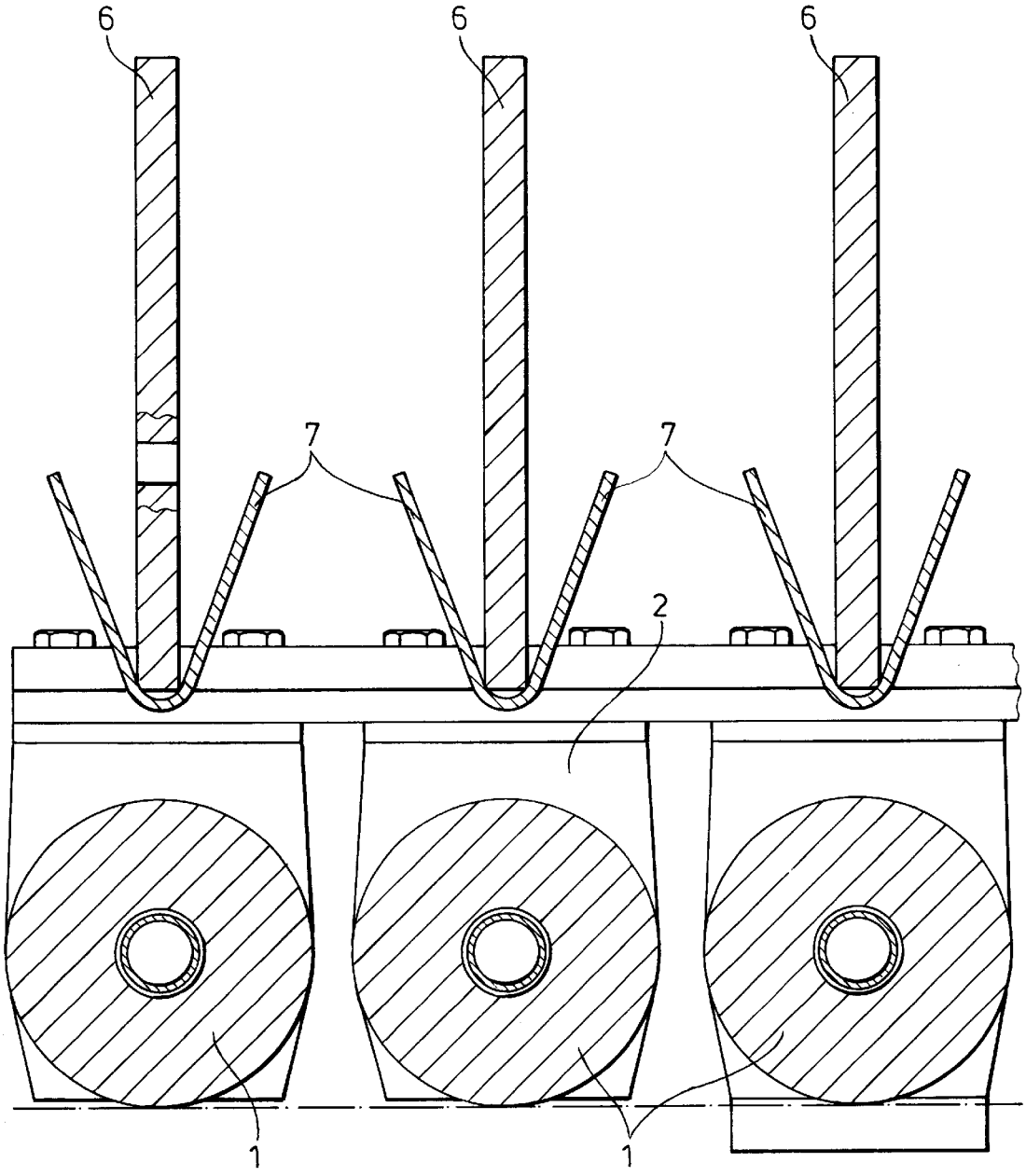
FIG. 4 is a side view showing a portion of the strand guiding segment with segment crossbeams and radiation protection plates mounted on the crossbeams.

FIG. 4 shows the advantageous use of radiation protection plates 7 on crossbeams 6 of the strand guiding segment. The illustration of FIG. 4 convincingly shows that the radiation protection plates 7 according to the invention are substantially simpler than conventional water-cooled segment crossbeams.

In view of the fact that the strand guiding segment according to the present invention is relatively uncomplicated, the invention meets the above-mentioned object in an optimum manner.

While specific embodiments of the invention have been shown and described in detail to illustrate the inventive principles, it will be understood that the invention may be embodied otherwise without departing from such principles.

We claim:

1. A strand guiding segment for slab casting plants, the segment comprising a first fixed frame portion and a second detachable frame portion, each frame portion having guide rollers, wherein the rollers of the first and second frame portions form therebetween an adjustable guide width for the strand, further comprising:

adjusting means for overcoming a ferrostatic pressure of the strand and for adjusting a desired sectional width of the strand, wherein the adjusting means are comprised of four independently adjustable pressure cylinders mounted outside of a radiation range of the strand and on an upper side of the segment, side frames comprised of box-shaped water-conducting ducts being laterally flanged to a bottom frame, water connections for a roller cooling system being arranged on one side of the strand guiding segment on the water-conducting duct, and wherein, the pressure cylinders being mounted with flanges thereof in spherically curved supports and connected through universal joints to the box-shaped side frames of the segment.

2. The strand guiding segment according to claim 1, wherein the segment further comprising crossbeams extending parallel to the rollers, and wherein radiation protection plates are mounted on the crossbeams.

3. The strand guiding segment according to claim 1, wherein a distance between a segment middle and the cylinder determining the width of the segment is reduced on both sides by a dimension of the cylinders when the cylinders are moved to the upper side of the segment.

4. The strand guiding segment according to claim 1, wherein the pressure cylinders are fixedly mounted on the strand guiding element and are connected through a double universal joint arrangement with free movement to all sides to the second frame.

* * * * *